US008672197B2

(12) United States Patent
Piazza et al.

(10) Patent No.: US 8,672,197 B2
(45) Date of Patent: Mar. 18, 2014

(54) LIQUID DISPENSER

(76) Inventors: Matthew Charles Piazza, Creve Coeur, MO (US); Tricia A. Piazza, Creve Coeur, MO (US)

( * ) Notice: Subject to any disclaimer, the term of this patent is extended or adjusted under 35 U.S.C. 154(b) by 0 days.

(21) Appl. No.: 13/400,096

(22) Filed: Feb. 19, 2012

(65) Prior Publication Data

US 2012/0211529 A1 Aug. 23, 2012

Related U.S. Application Data

(60) Provisional application No. 61/444,747, filed on Feb. 20, 2011.

(51) Int. Cl.
*B65D 47/00* (2006.01)

(52) U.S. Cl.
USPC ..... 222/527; 222/544; 222/185.1

(58) Field of Classification Search
USPC ..... 222/185.1, 529, 528, 527, 544, 518, 222/514
See application file for complete search history.

(56) References Cited

U.S. PATENT DOCUMENTS

| | | | | | |
|---|---|---|---|---|---|
| 246,093 | A | * | 8/1881 | Dennys | 222/514 |
| 600,901 | A | * | 3/1898 | Voelker | 222/514 |
| 707,193 | A | * | 8/1902 | Allison | 222/514 |
| 947,991 | A | * | 2/1910 | Hurt | 222/501 |
| 1,056,110 | A | * | 3/1913 | Miller | 138/134 |
| 1,247,497 | A | * | 11/1917 | Brown | 215/316 |
| 1,362,186 | A | * | 12/1920 | Price | 222/462 |
| 1,472,695 | A | * | 10/1923 | Stapley | 222/514 |
| 1,624,245 | A | * | 4/1927 | Holmes et al. | 222/611.1 |
| 1,750,512 | A | * | 3/1930 | Ewald | 222/400.7 |
| 1,764,642 | A | * | 6/1930 | Polk et al. | 222/183 |
| 2,011,009 | A | * | 8/1935 | Paige | 222/75 |
| 2,020,711 | A | * | 11/1935 | Warr | 222/181.2 |
| 2,223,854 | A | * | 12/1940 | Peaster | 222/509 |
| 2,576,509 | A | * | 11/1951 | Hren | 222/514 |
| 2,585,381 | A | * | 2/1952 | Cherba et al. | 222/514 |
| 2,684,787 | A | * | 7/1954 | Charpiat | 222/175 |
| 2,717,102 | A | * | 9/1955 | Rives | 222/89 |
| 2,792,976 | A | * | 5/1957 | Stewart | 222/569 |
| 3,165,241 | A | * | 1/1965 | Curry | 222/490 |
| 3,415,675 | A | * | 12/1968 | Allen | 427/300 |
| 3,476,111 | A | * | 11/1969 | Matheson | 604/92 |
| 3,537,456 | A | * | 11/1970 | Harautuneian et al. | 604/326 |
| 3,986,538 | A | * | 10/1976 | Sather | 141/332 |

(Continued)

OTHER PUBLICATIONS

Fermtech Product List [online], Fermtech Ltd., publication date Oct. 2009 [retrieved Jan. 12, 2011]. Retrieved from the Internet <URL: www.fermtech.ca/resources/oct09.List.pdf>.

*Primary Examiner* — Paul R Durand
*Assistant Examiner* — Donnell Long
(74) *Attorney, Agent, or Firm* — Dennis J M Donahue, III; CreatiVenture Law, LLC

(57) ABSTRACT

A device used to easily fill small containers, i.e. shot glasses, with hot or cold liquids, with precision and speed, without spillage. The device consists of a funnel, attached to a filler hose, with a specialized filler nozzle at the end. Liquid of choice is poured into the funnel. The liquid then flows through the hose, but will not come out until the user activates the nozzle. The nozzle is activated by gently pressing its tip on the floor of the container. The liquid dispenser device may be used to fill shot glasses with hot, liquid gelatin mixtures or can be used to fill other cups, such as communion cups.

20 Claims, 4 Drawing Sheets

(56) References Cited

U.S. PATENT DOCUMENTS

| | | | | | |
|---|---|---|---|---|---|
| 4,338,983 | A | * | 7/1982 | Hatcher | 141/331 |
| 4,420,097 | A | | 12/1983 | Motsenbocker | |
| 4,583,668 | A | * | 4/1986 | Maynard, Jr. | 222/529 |
| 4,600,125 | A | * | 7/1986 | Maynard, Jr. | 222/81 |
| 4,629,098 | A | | 12/1986 | Eger | |
| 4,715,516 | A | * | 12/1987 | Salvail | 222/153.14 |
| 4,834,151 | A | * | 5/1989 | Law | 141/198 |
| 4,964,542 | A | * | 10/1990 | Smith | 222/146.6 |
| 5,060,833 | A | | 10/1991 | Edison et al. | |
| 5,065,913 | A | * | 11/1991 | Glasener | 222/528 |
| 5,092,378 | A | | 3/1992 | Dunham | |
| 5,228,488 | A | * | 7/1993 | Fletcher | 141/331 |
| 5,560,522 | A | | 10/1996 | Clark | |
| 5,850,949 | A | * | 12/1998 | Koerbel et al. | 222/475 |
| 5,911,406 | A | | 6/1999 | Winefordner et al. | |
| 6,340,038 | B1 | * | 1/2002 | Ingram | 141/333 |
| 6,510,970 | B2 | * | 1/2003 | McLean et al. | 222/527 |
| 6,513,686 | B1 | | 2/2003 | Ben-Sasson | |
| 7,185,788 | B2 | * | 3/2007 | Morris | 222/129 |
| 7,237,582 | B1 | | 7/2007 | Harvey | |
| 7,631,789 | B2 | * | 12/2009 | Dodd et al. | 222/464.4 |
| 7,784,361 | B2 | * | 8/2010 | Wiedmann et al. | 73/861.52 |
| 2004/0069817 | A1 | * | 4/2004 | Jacques | 222/529 |
| 2009/0223596 | A1 | | 9/2009 | Wang | |

* cited by examiner

LIQUID DISPENSER

CROSS-REFERENCE TO RELATED APPLICATIONS

This application is a non-provisional of and claims priority to U.S. Provisional Patent Application Ser. No. 61/444,747 filed Feb. 20, 2012 and titled "LIQUID DISPENSER", which is herein incorporated in its entirety.

STATEMENT REGARDING FEDERALLY SPONSORED RESEARCH

Not Applicable.

APPENDIX

Not Applicable.

BACKGROUND OF THE INVENTION

The present invention relates to liquid dispensers, and particularly to liquid dispensers with manually actuated valves for controlling the flow of the liquid.

Shot glasses are typically filled with a liquid or fluid mixture using a pitcher, ladle, martini shaker, or measuring cup. All these instruments yield messy, inaccurate results with much waste. What is needed is a dispenser that efficiently and accurately fills shot glasses. The dispenser should be able to accommodate hot liquids as well as room temperature or cold liquids, and the dispenser should be easy to use.

The shot dispenser of the present invention fills a shot glass efficiently and accurately without spillage; using gravity to facilitate all liquid being used. Furthermore, it holds a large amount of liquid to make mass quantities of shots at once. The shot dispenser is ergonomically friendly, incorporating a handle so that hot liquids can also be used without warming and/or burning the user's hands. The one-touch operation of the valve stem to the floor of the receptacle increases the accuracy of fill dramatically to all known technology.

SUMMARY OF THE INVENTION

A liquid dispenser is provided having a container spout that is an orifice without any valve mechanism. The container spout may be attached to a funnel having a handle. In one embodiment, the funnel may be supported by a stand. An elongated tube extends from the container spout. The elongated tube includes a flexible tube in fluid communication with the container spout at a proximal end. The elongated tube also includes a rigid tube in fluid communication with a distal end of the flexible tube and extending to a dispensing end. A valve is situated at the dispensing end of the rigid tube.

The funnel holds a liquid or other fluid that is prevented from being dispensed from the liquid dispenser by the valve. A tip of the valve may be pressed against a bottom surface of a container, i.e. a shot glass, to open the valve and dispense the liquid therefrom. The rigid tube provides strength to the elongated tube to enable enough pressure to open the valve. While dispensing the liquid, a height between the container spout and the valve may be adjusted to adjust or control a flow rate of the liquid through the liquid dispenser.

BRIEF DESCRIPTION OF THE DRAWINGS

The present invention will become more fully understood from the detailed description and the accompanying drawings, FIGS. 1-4, wherein.

DETAILED DESCRIPTION OF THE PREFERRED EMBODIMENTS

Figure 1C:
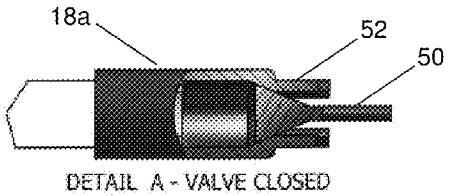
FIG. 1 is a schematic view of a liquid dispenser and valves formed in accordance with an embodiment.
Figure 1D:
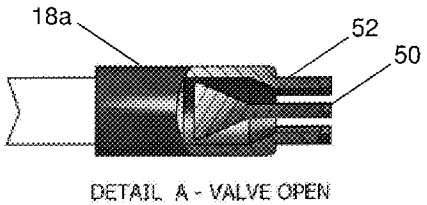
Figure 1E:
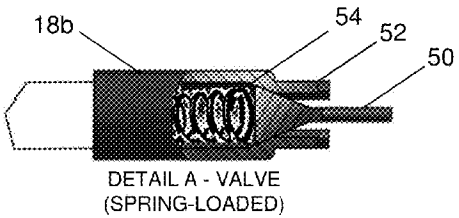
Figure 1B:
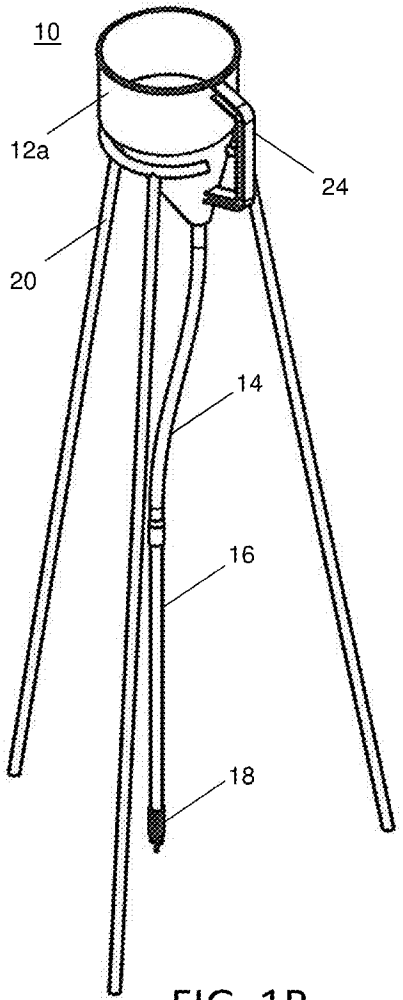
Figure 1A:
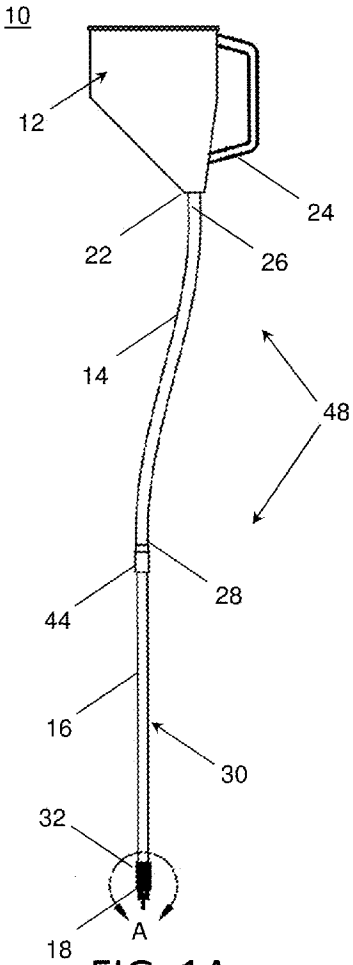

The following description of the preferred embodiment(s) is merely exemplary in nature and is in no way intended to limit the invention, its application, or uses.

As illustrated in FIG. 1, the present invention is for a liquid dispenser 10 which has a container 12 for holding a liquid or fluid 100, an elongated tube 14, 16 and a terminal valve 18. As used herein the terms "liquid" and "fluid" may include liquids or fluids containing particles of ice or other material, for example a slush-like drink. In some embodiments, the elongated tube includes a flexible tube 14 at the proximal end and a rigid tube 16 at the distal end. The container is preferably a funnel 12*a* with a handle 24 and has a spout 22 that is connected to one end 26 of the flexible tube 14. Optionally, the container may be a closed top container 12*b* that enables the liquid dispenser 10 to be stored on its side with liquid 100 therein. The other end 28 of the flexible tube is connected to the rigid tube 16. The rigid tube 16 is preferably elongated 30, extending to its dispensing end 32 where the stem valve 18 is preferably situated.

Figure 2:
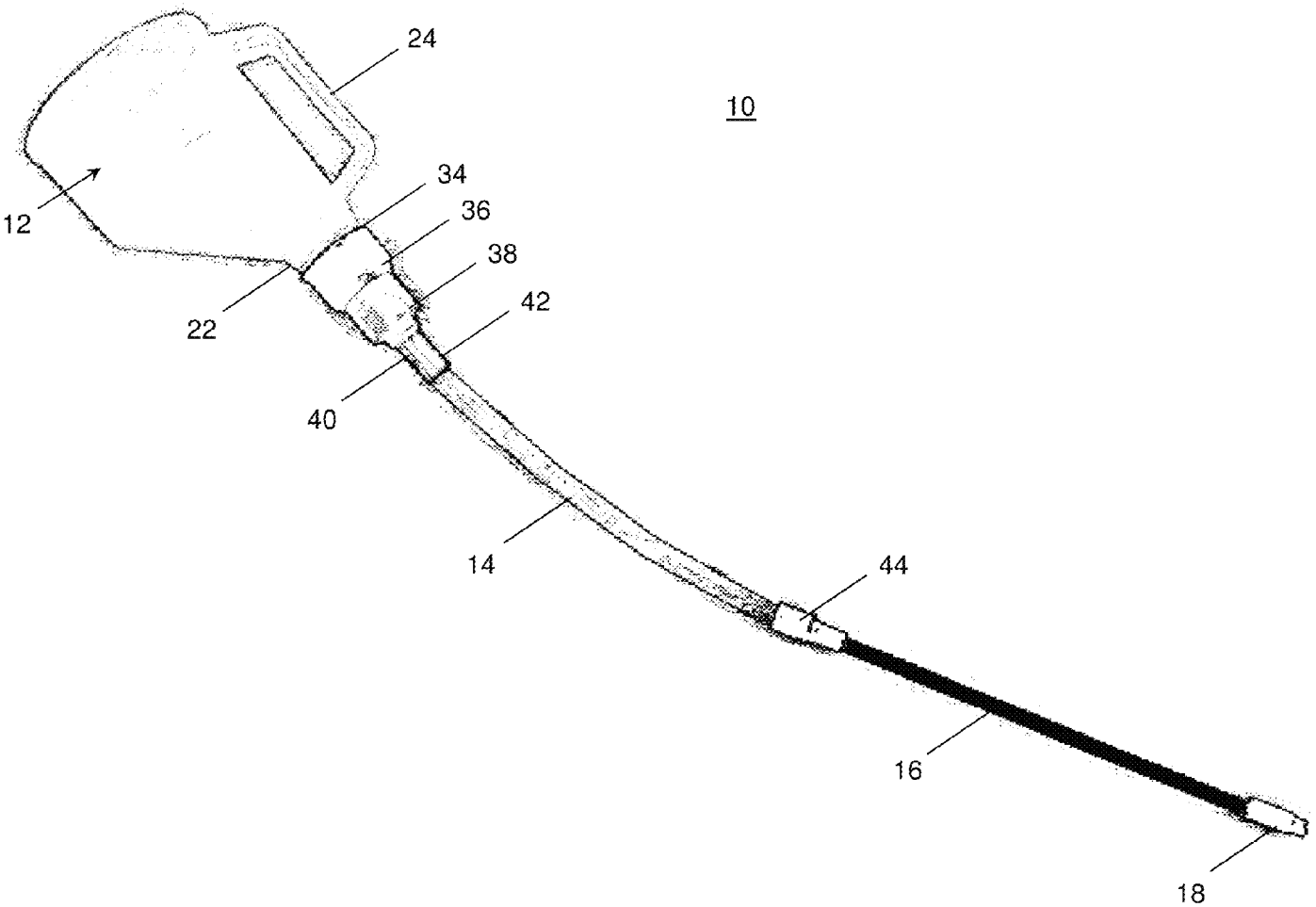
FIG. 2 is a perspective view of a liquid dispenser formed in accordance with another embodiment.

An alternative embodiment of the invention is shown in FIG. 2. In this embodiment, the container spout has a threaded collar 36 screwed over a threaded nozzle 34. The threaded collar has a reducer section 38 extending to an elongated tip 40. The ends of the flexible tube respectively extend over the elongated tip and the rigid tube in a friction fit 42 sleeve arrangement. There may also be a coupler 44 between the flexible tube and the rigid tube, and the flexible tube fits over one end of the coupler in a friction fit sleeve arrangement. The other end of the coupler extends over the rigid tube in a friction fit sleeve arrangement. The container spout 22, the flexible tube 14, the rigid tube 16 and the valve may be separable to enable cleaning, storage or the like.

Figure 3A:
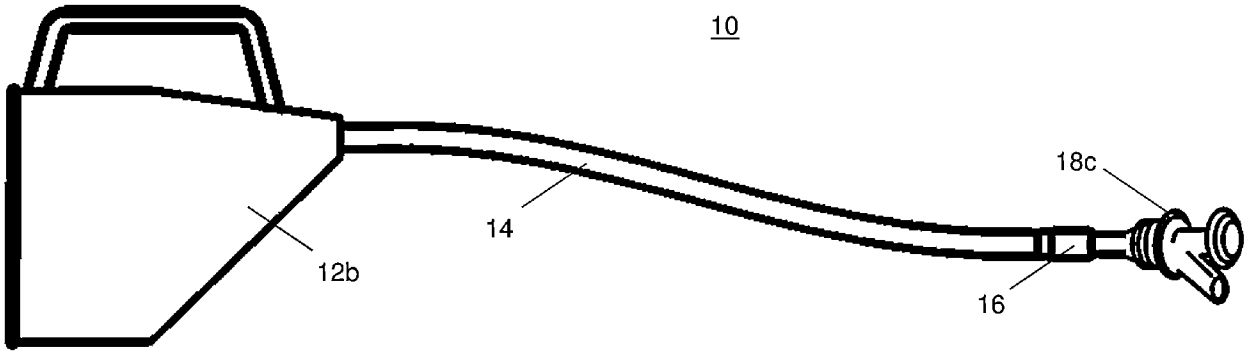
FIG. 3 is a side view of liquid dispensers formed in accordance with other embodiments.
Figure 3B:
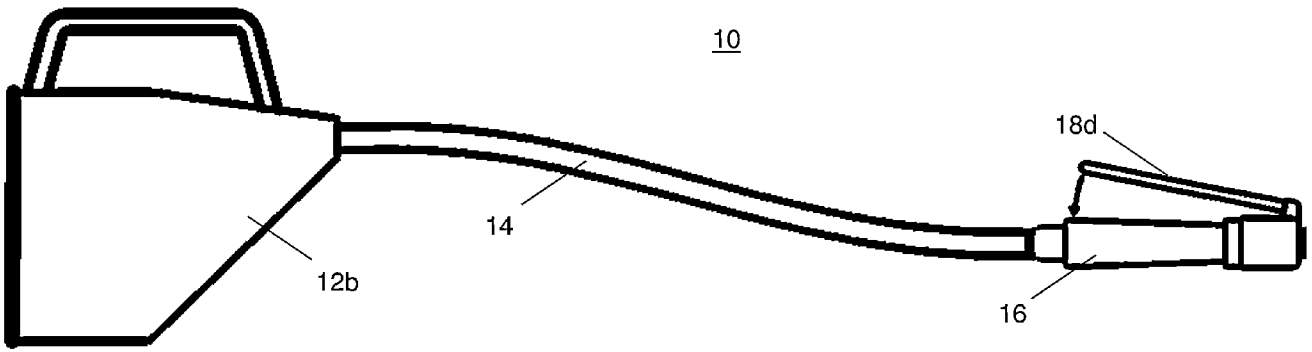

It will be appreciated that alternative valves 18 can be used with the liquid dispenser 10 of the present invention and that the container 12 can be held in place by a stand 20. As shown in FIG. 1, in addition to the stem valve 18*a*, other valves may be a spring-loaded stem valve 18*b*, a push-button spigot valve 18*c* and a squeeze-handle valve 18*d*. It will be appreciated that some of these alternate valves 18 may reduce the length of the rigid tube 16, and the rigid tube could be formed integrally with the valve. Examples of these options are shown in FIG. 3 with the push-button spigot valve 18*c* which has a shorter rigid tube than the stem valve and with the squeeze-handle valve 18*d* which has its own rigid tube integrally formed into the handle section.

Figure 4B:
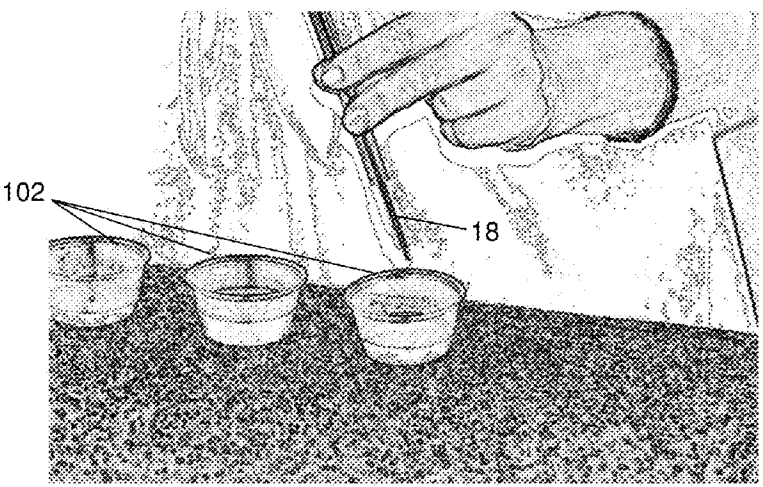
FIG. 4 are perspective views of a liquid dispenser in use and a tray with cups.
Figure 4B:
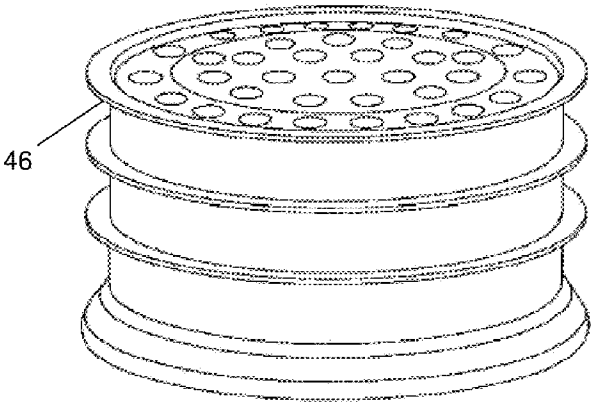
Figure 4A:
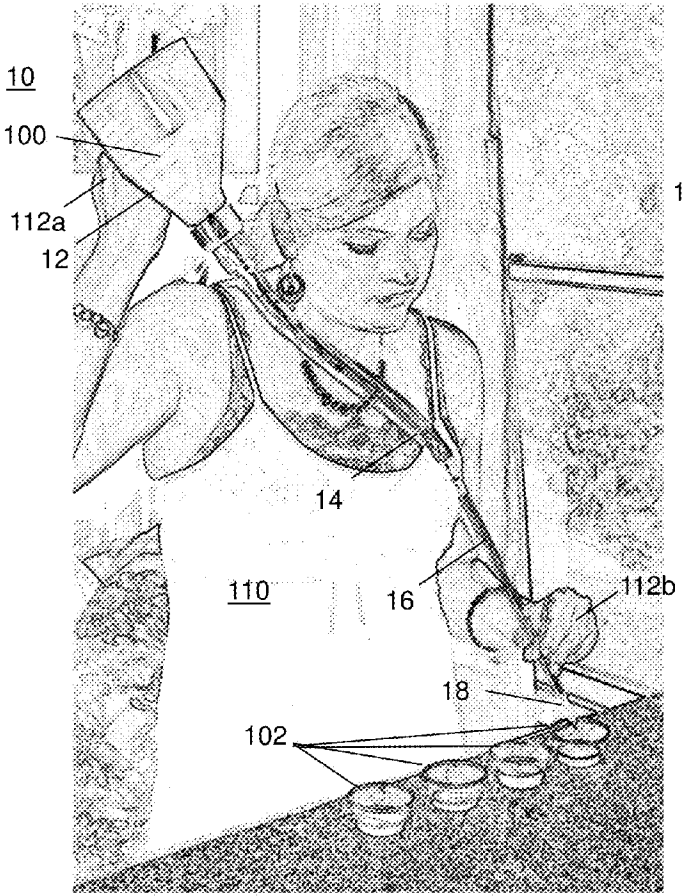

Operation of the liquid dispenser 10 is shown in FIG. 4. The liquid 100 is poured into the funnel 12*a* and flows through the flexible tube 14 and the rigid tube 16. The valve 18 is biased closed and prevents the liquid 100 from flowing into the receptacles to be filled. The user 110 activates the valve 18 with one hand 112*a* while preferably holding the funnel 12*a* with the other hand 112*b*. The flow of the liquid into the receptacle is gravity fed so the user can adjust the pressure using a differential in height 48 between the funnel and the terminal valve. By adjusting the pressure, a flow rate of the liquid through the fluid dispenser is adjusted. In particular, increasing the height between the funnel and the terminal valve increases a flow rate of the liquid through the liquid dispenser. Conversely, decreasing the height between the funnel and the terminal valve decreases the flow rate through the liquid dispenser.

In using the preferred dispenser 10, the user holds the liquid-filled funnel 12*a* by the handle 24 with one hand 112*a* in an elevated position over the receptacles 102 to be filled. With their other hand 112*b*, the user holds the tube 16 and presses the stem valve 18*a* against the bottom of each of the receptacles to open the stem valve and start the flow of liquid 100. When a receptacle is filled, the user pulls the tube away from the receptacle, thereby releasing the stem valve back to its biased-closed position to stop the flow of liquid.

The stem valve 18*a* is activated by pressing the central stem tip 50 on the base of the receptacle which causes the stem tip to move inwardly into the valve housing 52, thereby opening the valve and allowing the flow of liquid 100. When a desired fluid level is reached in the receptacle, the user lifts the stem tip away from the base of the receptacle, and the pressure of the liquid pushes the stem tip back to its seating in the valve housing, thereby closing the valve and stopping the flow of liquid. The stem valve 18*b* may have a spring 54 that biases the stem tip in the closed position. The push-button spigot valve 18*c* is hand-operated. Pushing the button into the housing opens the valve which is spring-biased so that the valve closes automatically when the button is released. Similarly, with the squeeze-handle valve 18*d*, the valve is opened by squeezing the handle and the valve closes automatically when the handle is released. It will be noted that each of these valve options allow the user to operate the valve and direct the location of the flow with one hand, thereby freeing the other hand to hold the funnel.

The dispenser 10 provides a convenient way to fill multiple cups 102 that may be arranged together on a table or in a tray. As one example of cups arranged in a tray, the dispenser can be used to fill cups held in a communion cup tray 46. The communion cups are used for individual servings of wine or juice during church communion services. Unfortunately the individual communion cups may be time consuming and difficult to fill without spilling the wine or juice. The dispenser elements may be sized for use in filling the individual communion cups, particularly including the valve. With the present invention, the cups can be arranged in the tray and individually filled using the dispenser without spilling the wine or juice. Accordingly, the communion cups may be more quickly filled, while creating less spillage. Of course, the cups could alternatively be filled by the inventive liquid dispenser before they are placed in the tray.

It should be noted that the illustrated embodiments include a dispenser have a single valve. As would be understood by one of ordinary skill in the art, additional valves may be added to the dispenser so that multiple cups could be filled at the same time. For example, the dispenser may be configured with multiple valves that enable a plurality of shot glasses to be lined up and filled simultaneously. In another example, the dispenser may be configured with multiple valves that correlate with the arrangement of cups in a particular arrangement, such as cups in the communion cup tray. Accordingly, each of the communion cups may be simultaneously filled by simultaneously pressing each of the multiple valves against the bottoms of the communion cups.

The embodiments were chosen and described to best explain the principles of the invention and its practical application to persons who are skilled in the art. As various modifications could be made to the exemplary embodiments, as described above with reference to the corresponding illustrations, without departing from the scope of the invention, it is intended that all matter contained in the foregoing description and shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

What is claimed is:

1. A liquid dispenser, comprising:

a container spout, wherein said container spout is an orifice without any valve mechanism;

a flexible tube in fluid communication with said container spout at a proximal end and extending to a distal end;

a rigid tube in fluid communication with said distal end of said flexible tube and extending to a dispensing end; and a valve situated at said dispensing end of said rigid tube.

2. The invention of claim 1, wherein said container spout is further comprised of a threaded nozzle and a threaded collar screwed over said threaded nozzle, wherein said threaded collar further comprises a reducer section extending to an elongated tip.

3. The invention of claim 2, wherein said proximal end and said distal end of said flexible tube respectively extend over said elongated tip and said rigid tube in a friction fit arrangement.

4. The invention of claim 2, further comprising a coupler at said distal end of said flexible tube, wherein one end of said coupler is fixed to said distal end of said flexible tube in a friction fit sleeve arrangement and wherein another end of said coupler is fixed to said rigid tube.

5. The invention of claim 1, wherein said proximal end of said flexible tube extends over said container spout in a friction fit arrangement and wherein said rigid tube is elongated, said elongated tube being longer than said valve.

6. The invention of claim 1, wherein said valve is selected from the group of valves consisting of a stem valve, a spring-loaded stem valve, a push-button spigot valve and a squeeze-handle valve.

7. The invention of claim 6, further comprising a receptacle in fluid communication with said valve, wherein said valve has a closed valve arrangement and an open valve arrangement, wherein said valve is biased to said closed valve arrangement and is actuated to said open valve arrangement by said receptacle when said valve is pressed against said receptacle.

8. The invention of claim 7, wherein said valve is further comprised of a housing and a central stem extending from an end of said housing, wherein said receptacle is further comprised of a base, wherein said central stem engages said base and is pushed into said housing in actuating said valve from said closed valve arrangement to said open valve arrangement, and wherein said central stem disengages from said base and is biased back to said end of said housing from said open valve arrangement to said closed valve arrangement.

9. The invention of claim 1 further comprising a funnel and a stand holding said funnel, wherein said funnel is attached to said container spout.

10. The invention of claim 1, wherein a height between said container spout and said valve is adjustable to adjust a flow rate of liquid through said liquid dispenser.

11. A liquid dispenser for filling a receptacle comprising:

a container comprising a spout, wherein said spout is an orifice without any valve mechanism;

an elongated flexible tube in fluid communication with said spout at a proximal end and extending a tube length to a distal end;

an elongated rigid tube in fluid communication with said distal end of said flexible tube and extending to a dispensing end, wherein a length of said elongated rigid tube is approximately equal to said tube length of said elongated flexible tube; and a valve situated at said dispensing end of said elongated rigid tube, wherein said valve has a closed valve arrangement in a disengaged relationship apart from the receptacle and an open valve arrangement in an engaged relationship with the receptacle, wherein said valve is biased to said closed valve arrangement according to said disengaged relationship and is actuated to said open valve arrangement by the receptacle according to said engaged relationship.

12. The invention of claim 11, wherein said spout is further comprised of a threaded nozzle and a threaded collar screwed over said threaded nozzle, wherein said threaded collar further comprises a reducer section extending to an elongated tip.

13. The invention of claim 12, wherein a proximal end of said flexible tube extends over said elongated tip in a friction fit arrangement.

14. The invention of claim 13, wherein said rigid tube is coupled to said flexible tube, said flexible tube further comprising a coupler at its distal end, wherein said distal end of said flexible tube fits over one end of said coupler in a friction fit sleeve arrangement and wherein another end of said coupler extends over said rigid tube in said friction fit sleeve arrangement.

15. The invention of claim 11, wherein said valve is further comprised of a housing and a stem extending from an end of said housing, wherein said stem engages the receptacle and is pushed into said housing in actuating said valve from said closed valve arrangement to said open valve arrangement, and wherein said stem disengages from the receptacle and is biased back to said end of said housing from said open valve arrangement to said closed valve arrangement.

16. The invention of claim 11, wherein said container further comprises a funnel and a handle.

17. The invention of claim 11, wherein said container is further comprised of a closed top container.

18. A liquid dispenser for filling a receptacle comprising:

a container comprising a funnel, a spout and at least one of a stand and a handle, wherein said spout is an orifice without any valve mechanism;

a flexible tube in fluid communication with said spout at a proximal end and extending to a distal end;

an elongated rigid tube in fluid communication with said distal end of said flexible tube and extending to a dispensing end; and a valve situated at said dispensing end of said rigid tube, wherein said valve is comprised of a housing and a stem extending from an end of said housing, wherein said stem engages the receptacle and is pushed into said housing in actuating said valve from a closed valve arrangement to an open valve arrangement, and wherein said stem disengages from the receptacle and is biased back to said end of said housing from said open valve arrangement to said closed valve arrangement.

19. The invention of claim 18, wherein a height between said spout and said valve is adjustable to control a flow rate of liquid through said flexible tube.

20. The invention of claim 19, wherein said spout comprises an elongated tip, wherein said proximal end of said flexible tube fits over said elongated tip in a friction fit arrangement and wherein said distal end of said flexible tube fits over said elongated rigid tube in said friction fit arrangement.

* * * * *